US011456578B2

(12) United States Patent
Saito et al.

(10) Patent No.: US 11,456,578 B2
(45) Date of Patent: Sep. 27, 2022

(54) SPARK PLUG

(71) Applicant: NGK SPARK PLUG CO., LTD., Nagoya (JP)

(72) Inventors: Koichiro Saito, Nagoya (JP); Susumu Imai, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 17/418,030

(22) PCT Filed: Oct. 1, 2020

(86) PCT No.: PCT/JP2020/037420

§ 371 (c)(1),
(2) Date: Jun. 24, 2021

(87) PCT Pub. No.: WO2021/111719

PCT Pub. Date: Mar. 10, 2021

(65) Prior Publication Data

US 2022/0094141 A1 Mar. 24, 2022

(30) Foreign Application Priority Data

Dec. 5, 2019 (JP) ..... JP2019-220097

(51) Int. Cl.
*H01T 13/32* (2006.01)
*H01T 13/36* (2006.01)
(Continued)

(52) U.S. Cl.
CPC ..... *H01T 13/36* (2013.01); *H01T 13/02* (2013.01); *H01T 13/32* (2013.01); *H01T 13/54* (2013.01); *H01T 13/39* (2013.01)

(58) Field of Classification Search
CPC ..... H01T 13/32; H01T 13/54; H01T 13/39
(Continued)

(56) References Cited

U.S. PATENT DOCUMENTS

2006/0276097 A1 12/2006 Suzuki et al.

FOREIGN PATENT DOCUMENTS

JP 2005-135783 A 5/2005
JP 2005-158322 A 6/2005
(Continued)

OTHER PUBLICATIONS

International Search Report from corresponding International Patent Application No. PCT/JP20/37420, dated Dec. 8, 2020.

*Primary Examiner* — Christopher M Raabe
(74) *Attorney, Agent, or Firm* — Kusner & Jaffe

(57) ABSTRACT

A spark plug including a center electrode; a metallic member forming a tubular shape around an axis of the spark plug, holding the center electrode therein, and having a hole formed in a side wall thereof and extending in a radial direction; and a ground electrode supported in the hole and extending from the hole toward the axis. The ground electrode has a fixing portion formed of metal and fixed to the hole, and an ignition portion containing a noble metal, disposed on a side toward the axis in relation to the fixing portion, and having a discharge surface for forming a gap between the ignition portion and the center electrode. The absolute value of the difference in coefficient of thermal expansion between the metallic member and the fixing portion is smaller than the absolute value of the difference in coefficient of thermal expansion between the metallic member and the ignition portion.

4 Claims, 10 Drawing Sheets

(51) Int. Cl.
*H01T 13/02* (2006.01)
*H01T 13/54* (2006.01)
*H01T 13/39* (2006.01)

(58) Field of Classification Search
USPC ..... 313/118
See application file for complete search history.

(56) References Cited

FOREIGN PATENT DOCUMENTS

| | | | | | |
|---|---|---|---|---|---|
| JP | 2019-46660 | A | | 3/2019 | |
| JP | 2020184433 | A | * | 11/2020 | ..... H01T 13/06 |

* cited by examiner

SPARK PLUG

FIELD OF THE INVENTION

The present disclosure relates to a spark plug for igniting an air-fuel mixture in, for example, an internal combustion engine.

BACKGROUND OF THE INVENTION

A known spark plug used for an internal combustion engine is disclosed in, for example, Japanese Patent Application Laid-Open (kokai) No. 2005-135783. This spark plug includes a tubular metallic shell, an insulator onto which the metallic shell is fitted, a center electrode provided in the insulator in such a manner that its ignition portion projects from the insulator, and a ground electrode disposed to face the ignition portion of the center electrode. The ground electrode has a ground electrode body bent to face the ignition portion of the center electrode approximately in parallel to the ignition portion, and an ignition portion disposed at a position in opposition to the ignition portion of the center electrode.

One end of the ground electrode body is fixed to a forward end surface of the metallic shell by means of welding, and the ignition portion is provided on a portion of the ground electrode body at the other end. The ignition portion is composed of a noble metal tip. The noble metal tip is fitted into a recess provided in the other end portion of the ground electrode body, and welding is performed along the boundary between the other end portion of the ground electrode body and the noble metal tip, whereby the ignition portion is formed.

BACKGROUND OF THE INVENTION

In recent years, in line with enhancement of engine performance, enhancement of the performance of spark plugs has been demanded, and one of the demanded performances is igniting performance. An effective way to enhance igniting performance is to increase the amount of projection of the noble metal tip attached to the ground electrode from the ground electrode body. For example, there has been proposed a spark plug in which the ground electrode body is eliminated, and a noble metal tip is fixed to a recess provided on the metallic shell. This configuration makes it possible to increase the amount of projection of the noble metal tip from the metallic shell.

However, in the case where the difference between the coefficient of thermal expansion of the metallic shell and the coefficient of thermal expansion of the metal constituting the noble metal tip is large, when the temperature of the spark plug becomes high, due to the difference in coefficient of thermal expansion, the force for holding the tip may decrease and the noble metal tip may come off. Also, since the noble metal is expensive, an increase in the amount of projection of the noble metal tip from the metallic shell leads to a corresponding increase in the amount of noble metal used, whereby the cost of production of spark plugs becomes very high.

SUMMARY OF THE INVENTION

A spark plug of the present disclosure comprises a center electrode; a metallic member provided to form a tubular shape around an axis of the spark plug and holding the center electrode therein in an insulated state, the metallic member having a hole formed in a side wall of the metallic member and extending in a radial direction; and a ground electrode supported in the hole and extending from the hole toward the axis, wherein the ground electrode has a fixing portion formed of a metal and fixed to the hole, and an ignition portion containing a noble metal, disposed on a side toward the axis in relation to the fixing portion, and having a discharge surface for forming a gap between the ignition portion and the center electrode, and wherein an absolute value of a difference in coefficient of thermal expansion between the metallic member and the fixing portion is smaller than an absolute value of a difference in coefficient of thermal expansion between the metallic member and the ignition portion.

According to the present disclosure, it is possible to prevent coming off of the ground electrode and reduce the production cost of the spark plug.

DETAILED DESCRIPTION OF THE INVENTION

Figure 1:
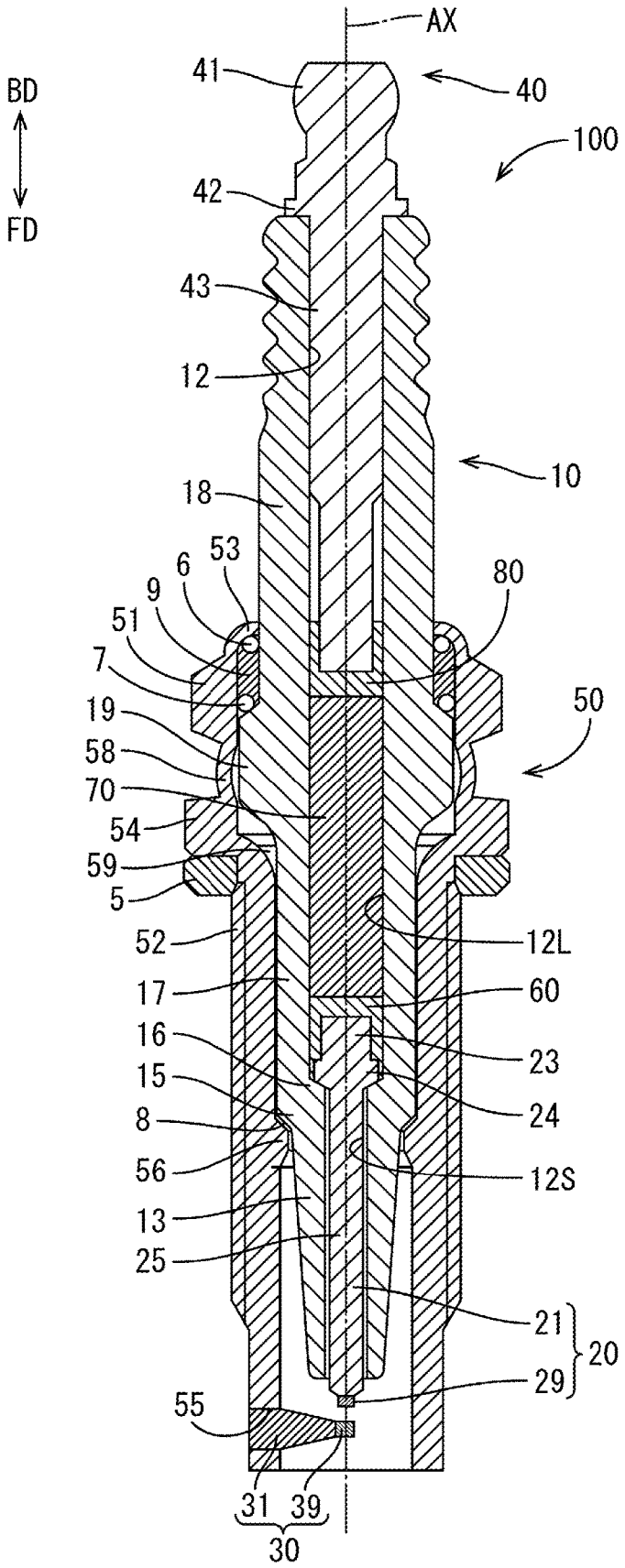
FIG. 1 is a sectional view of a spark plug of a first embodiment.

First, modes of the present disclosure will be listed and described.

(1) The spark plug of the present disclosure comprises a center electrode; a metallic member provided to form a tubular shape around an axis of the spark plug and holding the center electrode therein in an insulated state, the metallic member having a hole formed in a side wall of the metallic member and extending in a radial direction; and a ground electrode supported in the hole and extending from the hole toward the axis, wherein the ground electrode has a fixing portion formed of a metal and fixed to the hole, and an ignition portion containing a noble metal, disposed on a side toward the axis in relation to the fixing portion, and having a discharge surface for forming a gap between the ignition portion and the center electrode, and wherein an absolute value of a difference in coefficient of thermal expansion between the metallic member and the fixing portion is smaller than an absolute value of a difference in coefficient of thermal expansion between the metallic member and the ignition portion.

According to the above-described configuration, as compared with the coefficient of thermal expansion of the ignition portion, the coefficient of thermal expansion of the fixing portion assumes a value closer to the coefficient of thermal expansion of the metallic member. Therefore, it is possible to prevent a decrease in the force with which the fixing portion is held by the metallic member, due to the difference in coefficient of thermal expansion, when the temperature of the spark plug becomes high, thereby preventing coming off of the ground electrode.

(2) Preferably, the fixing portion is press-fitted into the hole, thereby being fixed thereto, and the fixing portion has a coefficient of thermal expansion greater than that of the ignition portion.

According to the above-described configuration, the coefficient of thermal expansion of the press-fitted portion is higher than the coefficient of thermal expansion of the ignition portion. Therefore, it is possible to more reliably prevent coming off of the ground electrode, which would otherwise occur when the temperature of the spark plug becomes high, as compared with the case where the press-fitted portion is formed of the noble metal. Also, since the noble metal used to form the ignition portion is expensive, by forming the press-fitted portion by using a metal which is less expensive than the noble metal, the production cost of the spark plug can be reduced.

(3) Preferably, the fixing portion is formed of Ni or an alloy containing Ni in a largest amount.

Since Ni or the alloy which contains Ni in the largest amount is less expensive than the noble metal, as compared with the case where the fixing portion is formed of the noble metal, the production cost of the spark plug can be reduced. Also, since Ni has a high melting point, the spark plug can exhibit sufficient performance in terms of resistance to abrasion caused by spark.

(4) Preferably, the ground electrode has the fixing portion, the ignition portion, and a connecting portion for connecting together the fixing portion and the ignition portion, wherein a cross-sectional area of the ground electrode at a boundary between the fixing portion and the connecting portion, as measured parallel to the axis and perpendicularly to an extension direction in which the ground electrode extends, is larger than a cross-sectional area of the ground electrode at an end portion of the connecting portion on a side toward the ignition portion, as measured parallel to the axis and perpendicularly to the extension direction of the ground electrode.

According to the above-described configuration, the cross-sectional area of the connecting portion at the boundary between the connecting portion and the fixing portion is larger than the cross-sectional area of the connecting portion at its end portion on the ignition portion side. Therefore, deformation or breakage due to vibration becomes less likely to occur at the boundary between the fixing portion and the connecting portion, whereby it becomes easier to prevent damage to the ground electrode. Also, the effect of conducting heat from the ignition portion toward the fixing portion can be enhanced.

(5) Preferably, the connecting portion has a taper portion.

According to the above-described configuration, the connecting portion has a taper portion. Therefore, when an air-fuel mixture is taken in, the air-fuel mixture easily flows into the gap between the center electrode and the discharge surface, and, when the air-fuel mixture is ignited, the connecting portion does not hinder combustion. Furthermore, since the taper portion is provided, deformation or breakage due to vibration is less likely to occur at the boundary between the fixing portion and the connecting portion, whereby damage to the ground electrode can be prevented more reliably.

[Details of First Embodiment of Present Disclosure]

A specific example of a spark plug of the present disclosure will now be described with reference to the drawings. Notably, the present disclosure is not limited to the example. The scope of the present disclosure is defined by the claims and is intended to include all modifications within the meanings and scopes equivalent to those of the claims.

<Overall Structure of Spark Plug>

Figure 2:
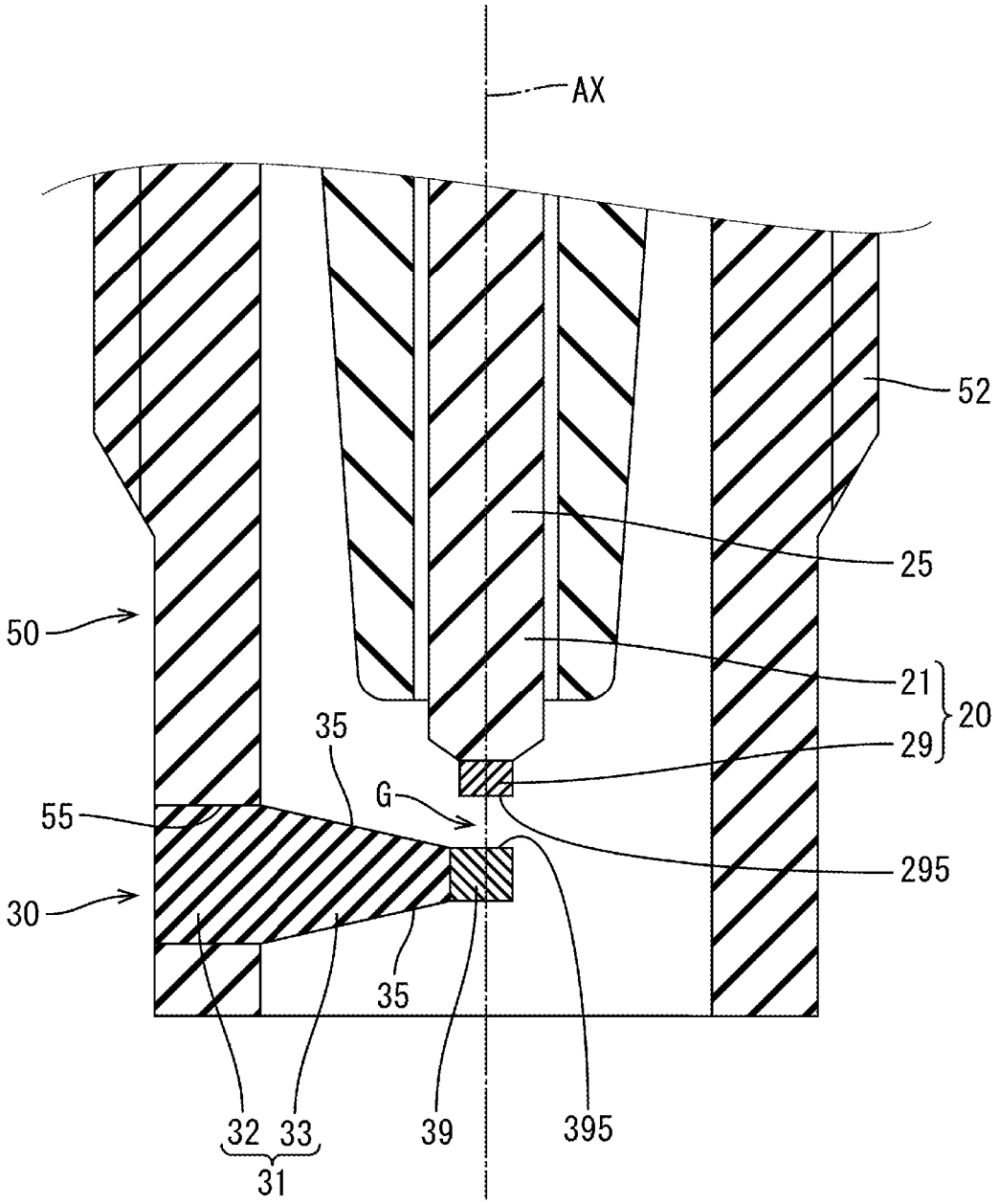
FIG. 2 is an enlarged sectional view of a forward end portion of the spark plug of FIG. 1.

FIG. 1 is a sectional view of a spark plug 100 of a first embodiment. FIG. 2 is an enlarged sectional view of a forward end portion of the spark plug 100 of FIG. 1. Alternate long and short dash lines in FIGS. 1 and 2 show the axis AX of the spark plug 100. A direction parallel to the axis AX (the vertical direction in FIGS. 1 and 2) will be referred to also as the axial direction. The radial direction of a circle on a plane perpendicular to the axis AX will be referred to simply as the "radial direction," and the circumferential direction of the circle will be referred to simply as the "circumferential direction." The circle on the plane perpendicular to the axis AX is not required to be a circle whose center is located on the axis AX; namely, the radial direction may be a direction which does not intersect with the axis AX. The downward direction in FIG. 1 will be referred as the forward end direction FD, and the upward direction in FIG. 1 will be referred as the rear end direction BD. The lower side in FIGS. 1 and 2 will be referred to as the forward end side of the spark plug 100, and the upper side in FIGS. 1 and 2 will be referred to as the rear end side of the spark plug 100.

The spark plug 100 is mounted onto an internal combustion engine and is used for igniting an air-fuel mixture in a combustion chamber of the internal combustion engine. The spark plug 100 includes an insulator 10, a center electrode 20, a ground electrode 30, a terminal electrode 40, a metallic shell 50, a resistor element 70, and electrically conductive seal members 60 and 80.

<Insulator>

The insulator 10 is an approximately cylindrical tubular member extending along the axis AX and having an axial hole 12 which is a penetration hole extending through the insulator 10. The insulator 10 is formed by using, for example, a ceramic material such as alumina. The insulator 10 has a flange portion 19, a rear-end-side trunk portion 18, a forward-end-side trunk portion 17, an outer diameter reducing portion 15, and a leg portion 13.

The flange portion 19 is a portion of the insulator 10 located approximately at the center in the axial direction. The rear-end-side trunk portion 18 is located on the rear end side of the flange portion 19 and has an outer diameter smaller than that of the flange portion 19. The forward-end-side trunk portion 17 is located on the forward end side of the flange portion 19 and has an outer diameter smaller than that of the rear-end-side trunk portion 18. The leg portion 13 is located on the forward end side of the forward-end-side trunk portion 17 and has an outer diameter smaller than that of the forward-end-side trunk portion 17. The outer diameter of the leg portion 13 is reduced toward the forward end side. When the spark plug 100 is mounted onto an internal combustion engine (not shown), the leg portion 13 is exposed to a combustion chamber of the internal combustion engine. The outer diameter reducing portion 15 is a portion formed between the leg portion 13 and the forward-end-side trunk portion 17 and decreasing in outer dimeter from the rear end side toward the forward end side.

On the inner circumferential side, the insulator 10 has a large inner diameter portion 12L located on the rear end side, a small inner diameter portion 12S located on the forward end side of the large inner diameter portion 12L and having an inner diameter smaller than that of the large inner diameter portion 12L, and an inner diameter reducing portion 16. The inner diameter reducing portion 16 is a portion formed between the large inner diameter portion 12L and the small inner diameter portion 12S and decreasing in inner dimeter from the rear end side toward the forward end side. In the present embodiment, the position of the inner diameter reducing portion 16 in the axial direction coincides with the position of a forward-end-side portion of the forward-end-side trunk portion 17.

<Metallic Shell>

The metallic shell 50 is a cylindrical tubular metallic member formed of an electrically conductive metallic material (for example, low carbon steel) and used to fix the spark plug 100 to the engine head (not shown) of the internal combustion engine. The metallic shell 50 has a penetration hole 59 extending therethrough along the axis AX. The metallic shell 50 is disposed on the radially outer side of the insulator 10 (namely around the insulator 10). Namely, the insulator 10 is inserted into and held in the penetration hole 59 of the metallic shell 50. The rear end of the insulator 10 projects from the rear end of the metallic shell 50 toward the rear end side.

The metallic shell 50 is provided to form a cylindrical tubular shape around the axis AX as a whole. The center electrode 20 is held in the metallic shell 50 in an insulated state. The metallic shell 50 has a hexagonal columnar tool engagement portion 51, with which a tool such as a plug wrench is engaged, a mounting screw portion 52 for mounting onto the internal combustion engine, and a flange-like bearing portion 54 formed between the tool engagement portion 51 and the mounting screw portion 52. The nominal diameter of the mounting screw portion 52 is, for example, M8 to M14.

An annular metal gasket 5 is interposed between the mounting screw portion 52 and the bearing portion 54 of the metallic shell 50. When the spark plug 100 is mounted onto the internal combustion engine, the gasket 5 seals the gap between the spark plug 100 and the internal combustion engine (engine head).

The metallic shell 50 further has a thin-walled crimp portion 53 provided on the rear end side of the tool engagement portion 51, and a thin-walled compressively deforming portion 58 provided between the bearing portion 54 and the tool engagement portion 51. Annular wire packings 6 and 7 are disposed in an annular region formed between an inner circumferential surface of a portion of the metallic shell 50 extending from the tool engagement portion 51 to the crimp portion 53 and an outer circumferential surface of the rear-end-side trunk portion 18 of the insulator 10. Powder of talc 9 is charged between the two wire packings 6 and 7 in that region. The rear end of the crimp portion 53 is bent toward the radially inner side and is fixed to the outer circumferential surface of the insulator 10. During manufacture, the compressively deforming portion 58 of the metallic shell 50 compressively deforms when the crimp portion 53 fixed to the outer circumferential surface of the insulator 10 is pressed toward the forward end side. As a result of the compressive deformation of the compressively deforming portion 58, via the wire packings 6 and 7 and the talc 9, the insulator 10 is pressed toward the forward end side within the metallic shell 50. The metallic shell 50 has a step portion 56 (shell-side step portion) formed at a position on the inner circumferential side of the mounting screw portion 52. The outer diameter reducing portion 15 (insulator-side step portion) of the insulator 10 is pressed by the step portion 56 via an annular plate packing 8. Namely, the plate packing 8 is held between the outer diameter reducing portion 15 and the step portion 56. As a result, the plate packing 8 prevents leakage of the air-fuel mixture within the combustion chamber of the internal combustion engine through the gap between the metallic shell 50 and the insulator 10.

<Center Electrode>

The center electrode 20 includes a rod-shaped center electrode body 21 extending along the axis AX, and an ignition portion 29. The center electrode body 21 is held in a forward-end-side portion of the axial hole 12 of the insulator 10. Namely, a rear-end-side portion of the center electrode 20 (a rear-end-side portion of the center electrode body 21) is disposed in the axial hole 12. The center electrode body 21 is formed of a metal having high corrosion resistance and high heat resistance, for example, nickel (Ni) or an alloy which contains nickel (Ni) in the largest amount (e.g., Ni alloy such as NCF600 or NCF601). The center electrode body 21 may have a two-layer structure including a base material formed of Ni or an Ni alloy, and a core embedded in the base material. In this case, the core is formed of, for example, copper (Cu), which is higher in heat conductivity than the base material, or an alloy which contains copper (Cu) in the largest amount.

The center electrode body 21 has a flange portion 24 provided at a predetermined position in the axial direction, a head portion 23 which is a portion located on the rear end side of the flange portion 24, and a leg portion 25 which is a portion located on the forward end side of the flange portion 24. The flange portion 24 is supported from the forward end side by the inner diameter reducing portion 16 of the insulator 10. Namely, the center electrode body 21 is engaged with the inner diameter reducing portion 16. A forward-end-side portion of the leg portion 25; namely, a forward-end-side portion of the center electrode body 21, projects toward the forward end side from the forward end of the insulator 10.

The ignition portion 29 is, for example, a member having an approximately circular columnar shape and is joined to the forward end of the center electrode body 21 (the forward end of the leg portion 25) by means of, for example, welding such as laser welding. The ignition portion 29 has a first discharge surface 295 at its forward end. A spark gap is formed between the first discharge surface 295 and an ignition portion 39, which will be described later. The ignition portion 29 is composed of, for example, a center electrode tip formed of a noble metal having high melting point such as iridium (Ir) or platinum (Pt) or an alloy which contains the noble metal in the largest amount.

<Terminal Electrode>

The terminal electrode 40 is a rod-shaped member extending in the axial direction. The terminal electrode 40 is inserted into the axial hole 12 of the insulator 10 from the rear end side and is located on the rear end side of the center electrode 20 within the axial hole 12. The terminal electrode 40 is formed of an electrically conductive metallic material (for example, low carbon steel), and the surface of the terminal electrode 40 is plated with, for example, Ni for preventing corrosion.

The terminal electrode 40 has a flange portion 42 formed at a predetermined position in the axial direction, a cap attachment portion 41 located on the rear end side of the flange portion 42, and a leg portion 43 located on the forward end side of the flange portion 42. The cap attachment portion 41 of the terminal electrode 40 is exposed on the rear end side of the insulator 10. The leg portion 43 of the terminal electrode 40 is inserted into the axial hole 12 of the insulator 10. An unillustrated plug cap to which an unillustrated high-voltage cable is connected is attached to the cap attachment portion 41, whereby a high voltage for generating discharge is applied to the terminal electrode 40.

<Resistor Element>

The resistor element 70 is disposed in the axial hole 12 of the insulator 10 to be located between the forward end of the terminal electrode 40 and the rear end of the center electrode 20. The resistor element 70 has a resistance of for example, 1 KΩ or larger (for example, 5 KΩ), and has a function of reducing radio noise generated as a result of generation of spark. The resistor element 70 is formed of, for example, a composition including glass particles (main component), ceramic particles other than the glass particles, and an electrically conductive material.

A gap is provided between the forward end of the resistor element 70 and a rear end portion of the center electrode 20 within the axial hole 12, and this gap is filled with an electrically conductive seal member 60. Meanwhile, another gap is provided between the rear end of the resistor element 70 and a forward end portion of the terminal electrode 40 within the axial hole 12, and this gap is filled with an electrically conductive seal member 80. Namely, the seal member 60 is in contact with both the center electrode 20 and the resistor element 70 and provides a spacing between the center electrode 20 and the resistor element 70. The seal member 80 is in contact with both the resistor element 70 and the terminal electrode 40 and provides a spacing between the resistor element 70 and the terminal electrode 40. As described above, the seal members 60 and 80 establish electrical and physical connection between the center electrode 20 and the terminal electrode 40 via the resistor element 70. The seal members 60 and 80 are formed of an electrically conductive material; for example, a composition containing particles of glass (for example, $B_2O_3$—$SiO_2$ glass) and particles of a metal (for example, Cu or Fe).

<Hole>

A hole 55 extending in the radial direction is provided in a side wall of the metallic shell 50. The ground electrode 30 is inserted into the hole 55 of the metallic shell 50 and is fixed in this state. The radial direction in which the hole 55 extends may be a direction which does not intersect with the axis AX. The forward end of the metallic shell 50 is located on the forward end side in relation to the forward end of the center electrode 20, and the ground electrode 30 is disposed at a position between the forward end of the metallic shell 50 and the forward end of the center electrode 20 as viewed in the axial direction. The hole 55 is provided in such a manner to penetrate, in the radial direction, the circumferential wall of the metallic shell 50, which defines the penetration hole 59.

<Ground Electrode>

As shown in FIG. 2, the ground electrode 30 is supported in the hole 55 and extends from the hole 55 toward the axis AX. The ground electrode 30 includes a ground electrode body 31 fixedly inserted into the hole 55, and the ignition portion 39 fixed to the distal end of the ground electrode body 31. The ground electrode body 31 is formed of a metal having high corrosion resistance and high heat resistance, for example, nickel (Ni) or an alloy which contains nickel (Ni) in the largest amount (e.g., Ni alloy such as NCF600 or NCF601). The ground electrode body 31 may have a multilayer structure including a base material formed of Ni or an Ni alloy, and a core embedded in the base material. In this case, the core is formed of, for example, copper (Cu), which is higher in heat conductivity than the base material, or an alloy which contains copper (Cu) in the largest amount.

Figure 3:
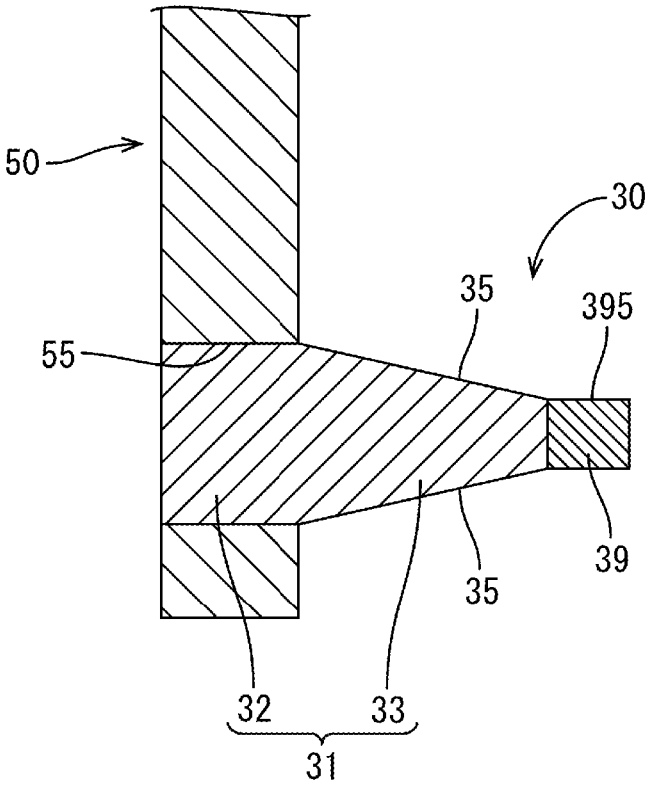
FIG. 3 is a sectional view showing a mounting structure between a metallic shell and a ground electrode.

As shown in FIG. 3, the ground electrode body 31 has an approximately columnar shape, and has a press-fitted portion 32 press-fitted into the hole 55, and a connecting portion 33 connecting together the press-fitted portion 32 and the ignition portion 39. The press-fitted portion 32 corresponds to the "fixing portion" in the claims. The connecting portion 33 is formed integrally with the press-fitted portion 32. The ground electrode 30 is fixed to the metallic shell 50 as a result of the press-fitted portion 32 being press-fitted into the hole 55. Meanwhile, the connecting portion 33 and the ignition portion 39 are joined together by means of, for example, welding such as laser welding. The connecting portion 33 is tapered in such a manner that the cross-sectional area of the connecting portion 33 decreases from the boundary between the press-fitted portion 32 and the connecting portion 33 toward the end of the connecting portion 33 on the side toward the ignition portion 39. This cross-sectional area refers to the area of cross section of the connecting portion 33 parallel to the axis AX and perpendicular to the extension direction of the ground electrode 30. The extension direction of the ground electrode 30 may be a direction which does not intersect with the axis AX.

The ignition portion 39 is composed of a ground electrode tip containing a noble metal. For example, the ground electrode tip is formed of a noble metal having high melting point such as iridium (Ir) or platinum (Pt) or an alloy which contains the noble metal in the largest amount. The ignition portion 39 is, for example, a member having an approximately circular columnar shape, and has a second discharge surface 395, which faces the first discharge surface 295 of the center electrode 20. As shown in FIG. 2, a gap G is formed between the first discharge surface 295 of the center electrode 20 and the second discharge surface 395 of the ground electrode 30. The gap G is a so-called spark gap at which discharge occurs.

Figure 4:
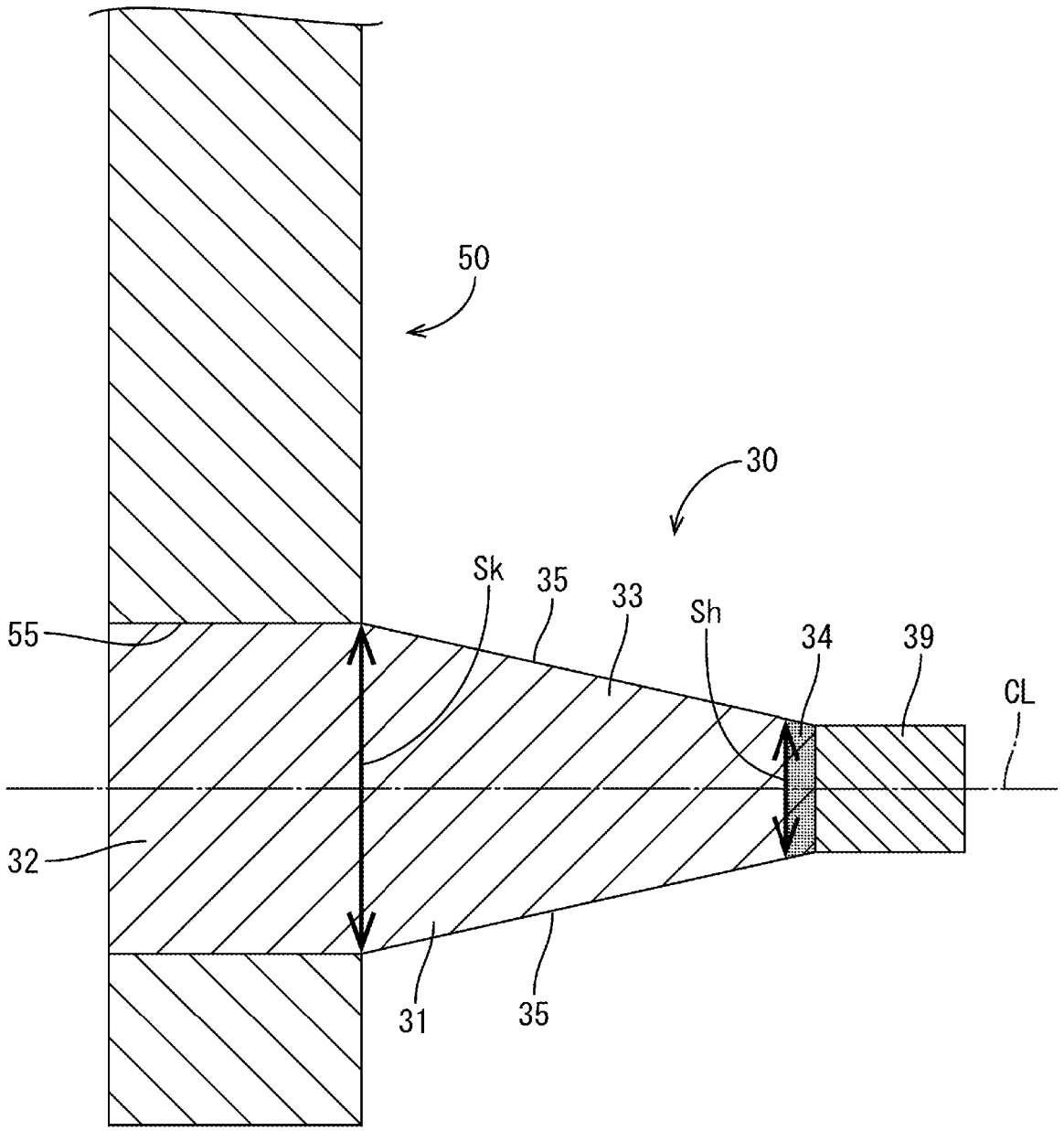
FIG. 4 is an enlarged sectional view of the ground electrode.

Specifically, as shown in FIG. 4, a weld portion 34 is formed between the connecting portion 33 and the ignition portion 39. The weld portion 34 is formed of weld metals composed of the metal of the connecting portion 33 and the metal of the ignition portion 39. A cross-sectional area Sk of the ground electrode body 31 at the boundary between the press-fitted portion 32 and the connecting portion 33 is larger than a cross-sectional area Sh of the ground electrode body 31 at an end portion of the connecting portion 33 on the side toward the ignition portion 39. The cross-sectional area Sk and the cross-sectional area Sh are measured parallel to the axis AX and perpendicularly to the extension direction of the ground electrode 30. In FIG. 4, the end portion of the connecting portion 33 on the side toward the ignition portion 39 corresponds to the boundary between the connecting portion 33 and the weld portion 34. However, in the case where the connecting portion 33 and the ignition portion 39 are fixed to each other by means of press-fitting rather than welding, the cross-sectional area Sh may be measured at the boundary between the connecting portion 33 and the ignition portion 39.

The connecting portion 33 has the shape of a truncated cone whose center is located at a center line CL and is formed such that the diameter of the connecting portion 33 decreases toward the ignition portion 39 from the boundary between the press-fitted portion 32 and the connecting portion 33. Since the connecting portion 33 and the ignition portion 39 project from the hole 55 and the ignition portion 39 contains a noble metal, the centroid of the ground electrode 30 deviates toward the ignition portion 39 side from that of an ordinary ground electrode. Therefore, large load is generated on the press-fitted portion 32 side due to vibration of the engine. However, the ground electrode body 31 is not broken, because the diameter of the connecting portion 33 measured on the press-fitted portion 32 side is larger than that measured on the ignition portion 39 side and therefore, the rigidity of the ground electrode body 31 on the press-fitted portion 32 side is high. Also, the effect of conducting heat from the ignition portion 39 side toward the press-fitted portion 32 is high, whereby resistance to abrasion caused by combustion can be increased.

A pair of taper portions 35 are provided on the forward and rear end surfaces of the connecting portion 33. The taper portions 35 are formed in such a manner that the distances between the taper portions 35 and the center line CL decrease from the boundary between the press-fitted portion 32 and the connecting portion 33 toward the boundary between the connecting portion 33 and the ignition portion 39. When an air-fuel mixture combusts as a result of ignition, the combustion spreads from the ignition portion 39. Since the taper portions 35 are provided, the combustion is not hindered. Also, when an air-fuel mixture is taken in, the flow of the air-fuel mixture toward the ignition portion 39 is not hindered, because the taper portions 35 are provided.

The ground electrode 30 is fixed to the metallic shell 50 as a result of the press-fitted portion 32 being press-fitted into the hole 55. The hole 55 is a circular hole whose diameter is maintained constant in the extension direction of the ground electrode 30. Meanwhile, the dimension of the press-fitted portion 32 in the axial direction is maintained constant in the extension direction of the ground electrode 30. Therefore, of the press-fitted portion 32, a portion disposed in the hole 55 is in contact with the inner circumferential surface of the hole 55, with no gap formed therebetween, over the entire circumference and over the entire length in the extension direction of the ground electrode 30. Therefore, the press-fitted portion 32 is in contact with the opening edge of the hole 55 with no gap formed therebetween.

Meanwhile, the difference in coefficient of thermal expansion between the metallic shell 50 and the press-fitted portion 32 is rendered smaller than the difference in coefficient of thermal expansion between the metallic shell 50 and the ignition portion 39. Moreover, the coefficient of thermal expansion of the press-fitted portion 32 is rendered higher than the coefficient of thermal expansion of the ignition portion 39. When an air-fuel mixture combusts, the temperature of the spark plug 100 becomes high. Therefore, the diameter of the hole 55 of the metallic shell 50 increases, and the press-fitted portion 32 may loosen. In an assumed case where the ground electrode body 31 is formed of the same metal as the ignition portion 39, when the press-fitted portion 32 receives a force due to vibration of the engine, problems such as coming off of the ground electrode body 31 from the hole 55 may occur. In view of this, in the present embodiment, the coefficient of thermal expansion of the press-fitted portion 32 is set to be closer to the coefficient of thermal expansion of the metallic shell 50, as compared with the coefficient of thermal expansion of the ignition portion 39. Therefore, it is possible to avoid loosening of the press-fitted portion 32.

<Method for Measuring Coefficient of Thermal Expansion>

Next, a method for measuring the coefficients of thermal expansion of the press-fitted portion 32 and the ignition portion 39 will be described. Coefficient of thermal expansion is measured by TMA (Thermomechanical Analysis) (compression mode). Samples having the same dimensions and shape are cut out from the press-fitted portion 32 and the ignition portion 39. The coefficients of thermal expansion of a plurality of (for example, 30 or more) samples of the press-fitted portion 32 are measured, and the average of the coefficients is used as the coefficient of thermal expansion of the press-fitted portion 32. Similarly, the coefficients of thermal expansion of a plurality of (for example, 30 or more) samples of the ignition portion 39 are measured, and the average of the coefficients is used as the coefficient of thermal expansion of the ignition portion 39. A single sample of the press-fitted portion 32 and a single sample of the ignition portion 39 are cut out from a single plug at respective arbitrary points. The number of the samples of the press-fitted portion 32 used for calculating the average is the same as the number of the samples of the ignition portion 39 used for calculating the average.

<Effects of First Embodiment>

In the above-described spark plug 100 of the present embodiment, as compared with the coefficient of thermal expansion of the ignition portion 39, the coefficient of thermal expansion of the press-fitted portion 32 assumes a value closer to the coefficient of thermal expansion of the metallic shell 50. Therefore, it is possible to prevent a decrease in the force with which the press-fitted portion 32 is held by the metallic shell 50, due to the difference in coefficient of thermal expansion when the temperature of the spark plug 100 becomes high, thereby preventing coming off of the ground electrode 30.

Since the press-fitted portion 32 is fixed by being press-fitted into the hole 55 and the coefficient of thermal expansion of the press-fitted portion 32 is higher than the coefficient of thermal expansion of the ignition portion 39, it is possible to more reliably prevent coming off of the ground electrode 30, which would otherwise occur when the temperature of the spark plug 100 becomes high, as compared with the case where the press-fitted portion 32 is formed of a noble metal. Also, since the noble metal used to form the ignition portion 39 is expensive, by forming the press-fitted portion 32 by using a metal which is less expensive than the noble metal, the production cost of the spark plug 100 can be reduced.

The press-fitted portion 32 is formed of Ni or an alloy which contains Ni in the largest amount. Since Ni or the alloy which contains Ni in the largest amount is less expensive than the noble metal, as compared with the case where the press-fitted portion 32 is formed of the noble metal, the production cost of the spark plug 100 can be reduced. Also, since Ni has a high melting point, the spark plug 100 can exhibit sufficient performance in terms of resistance to abrasion caused by spark.

The ground electrode 30 has the press-fitted portion 32, the ignition portion 39, and the connecting portion 33 for connecting the press-fitted portion 32 and the ignition portion 39. The cross-sectional area of the ground electrode 30 at the boundary between the press-fitted portion 32 and the connecting portion 33, as measured parallel to the axis AX and perpendicularly to the extension direction of the ground electrode 30, is larger than the cross-sectional area of the ground electrode 30 at an end portion of the connecting portion 33 on the side toward the ignition portion 39, as measured parallel to the axis AX and perpendicularly to the extension direction of the ground electrode 30. In the case where the ground electrode 30 is configured as described above, the cross-sectional area of the connecting portion 33 at the boundary between the connecting portion 33 and the press-fitted portion 32 is larger than the cross-sectional area of the connecting portion 33 at its end portion on the ignition portion 39 side. Therefore, deformation or breakage due to vibration becomes less likely to occur at the boundary between the press-fitted portion 32 and the connecting portion 33, whereby it becomes easier to prevent damage to the ground electrode 30. Also, the effect of conducting heat from the ignition portion 39 toward the press-fitted portion 32 can be enhanced.

The connecting portion 33 has the taper portion 35. Since the connecting portion 33 has the taper portion 35, when an air-fuel mixture is taken in, the air-fuel mixture easily flows into the gap G between the center electrode 20 and the discharge surface 395, and, when the air-fuel mixture is ignited, the connecting portion 33 does not hinder combustion. Furthermore, since the taper portion 35 is provided, deformation or breakage due to vibration is less likely to occur at the boundary between the press-fitted portion 32 and the connecting portion 33, whereby damage to the ground electrode 30 can be prevented more reliably.

[Details of Second Embodiment of Present Disclosure]

Figure 5:
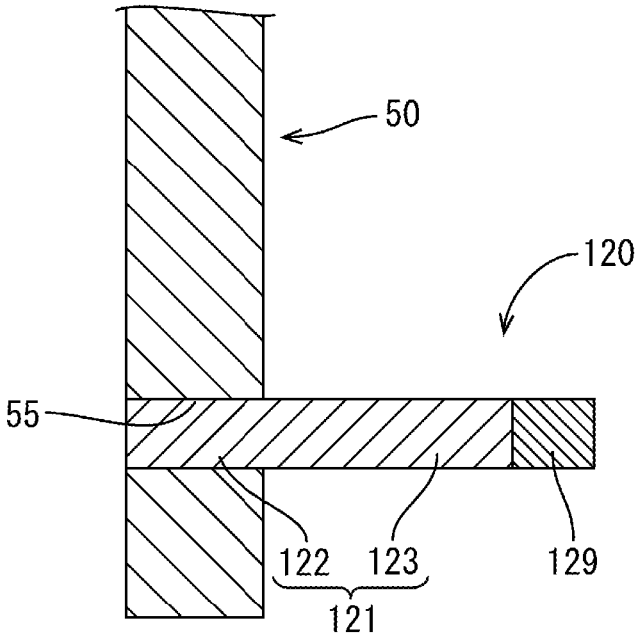
FIG. 5 is a sectional view showing the mounting structure between the metallic shell and the ground electrode in a second embodiment.

Next, a second embodiment in which the structure of the ground electrode 30 of the first embodiment is changed will be described with reference to FIG. 5. The same structural elements as those of the first embodiment are denoted by the same reference numerals, and their descriptions will not be repeated. A ground electrode 120 of the second embodiment has a ground electrode body 121 projecting from the hole 55, and an ignition portion 129 fixed to a projecting end of the ground electrode body 121. The ground electrode body 121 has an approximately columnar shape, and has a press-fitted portion 122 press-fitted into the hole 55, and a connecting portion 123 connecting together the press-fitted portion 122 and the ignition portion 129. The press-fitted portion 122 corresponds to the "fixing portion" in the claims. The connecting portion 123 is formed integrally with the press-fitted portion 122. Meanwhile, the connecting portion 123 and the ignition portion 129 are joined together by means of, for example, welding such as laser welding.

The connecting portion 123 has a constant cross-sectional area from the boundary between the press-fitted portion 122 and the connecting portion 123 to its end portion on the side toward the ignition portion 129. Also, the cross-sectional area of the press-fitted portion 122 is the same as the cross-sectional area of the connecting portion 123. Moreover, the cross-sectional area of the ignition portion 129 is the same as the cross-sectional area of the connecting portion 123. The size of the ignition portion 129 is the same as the size of the ignition portion 39 of the first embodiment. Meanwhile, the size of the ground electrode body 121 is smaller than the size of the ground electrode body 31 of the first embodiment.

[Details of Third Embodiment of Present Disclosure]

Figure 6:
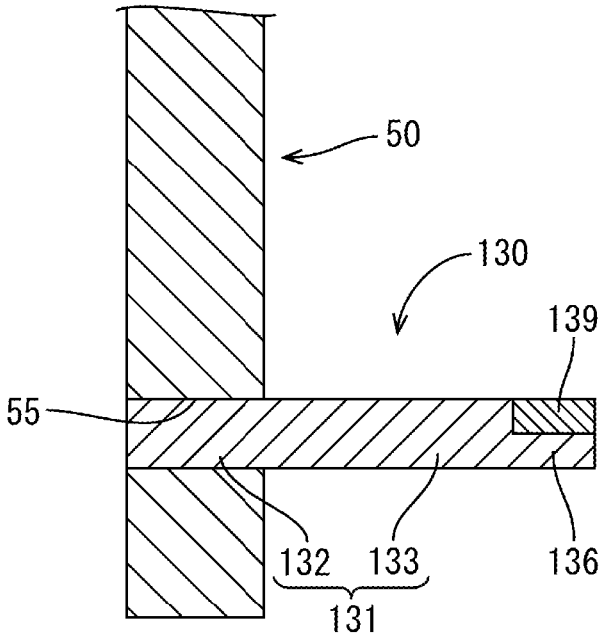
FIG. 6 is a sectional view showing the mounting structure between the metallic shell and the ground electrode in a third embodiment.

Next, a third embodiment in which the structure of the ground electrode 120 of the second embodiment is partially changed will be described with reference to FIG. 6. The same structural elements as those of the first embodiment are denoted by the same reference numerals, and their descriptions will not be repeated. A ground electrode 130 of the third embodiment has a ground electrode body 131 projecting from the hole 55, and an ignition portion 139 fixed to a projecting end of the ground electrode body 131. The ground electrode body 131 has an approximately columnar shape, and has a press-fitted portion 132 press-fitted into the hole 55, and a connecting portion 133 connecting together the press-fitted portion 132 and the ignition portion 139. The press-fitted portion 132 corresponds to the "fixing portion" in the claims. The connecting portion 133 is formed integrally with the press-fitted portion 132. Meanwhile, the connecting portion 133 and the ignition portion 139 are joined together by means of, for example, welding such as laser welding.

The ignition portion 139 has a thickness which is half of the thickness of the ignition portion 129 of the second embodiment. Therefore, an extension portion 136 is provided at the projecting end of the connecting portion 133 and extends along the forward end surface of the ignition portion 129. Accordingly, the ignition portion 139 is joined to both the projecting end of the connecting portion 133 and the rear end surface of the extension portion 136.

[Details of Fourth Embodiment of Present Disclosure]

Figure 7:
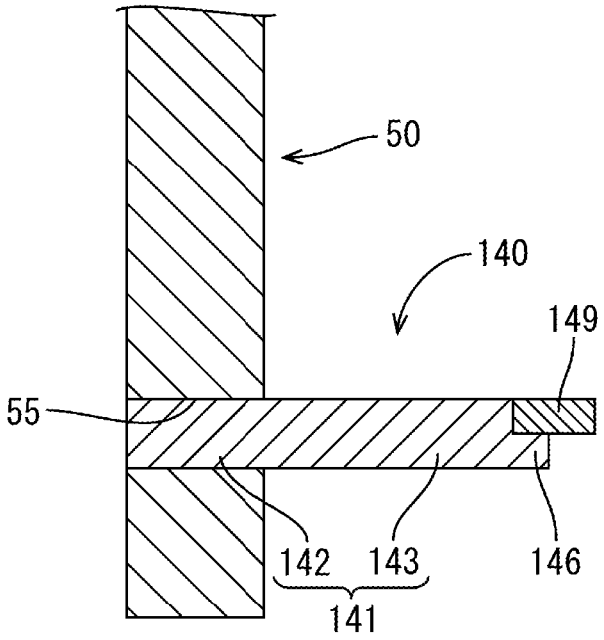
FIG. 7 is a sectional view showing the mounting structure between the metallic shell and the ground electrode in a fourth embodiment.

Next, a fourth embodiment in which the structure of the ground electrode 130 of the third embodiment is partially changed will be described with reference to FIG. 7. The same structural elements as those of the first embodiment are denoted by the same reference numerals, and their descriptions will not be repeated. A ground electrode 140 of the fourth embodiment has a ground electrode body 141 projecting from the hole 55, and an ignition portion 149 fixed to a projecting end of the ground electrode body 141. The ground electrode body 141 has an approximately columnar shape, and has a press-fitted portion 142 press-fitted into the hole 55, and a connecting portion 143 connecting together the press-fitted portion 142 and the ignition portion 149. The press-fitted portion 142 corresponds to the "fixing portion" in the claims. The connecting portion 143 is formed integrally with the press-fitted portion 142. Meanwhile, the connecting portion 143 and the ignition portion 149 are joined together by means of, for example, welding such as laser welding.

The ignition portion 149 has the same size as the ignition portion 139 of the third embodiment. In the present embodiment as well, an extension portion 146 is provided at the projecting end of the connecting portion 133 and extends along the forward end surface of the ignition portion 149. However, the length of the extension portion 146 in the extension direction is half of the extension portion 136 of the third embodiment. Accordingly, half of the ignition portion 149 projects from the extension portion 146.

[Details of Fifth Embodiment of Present Disclosure]

Figure 8:
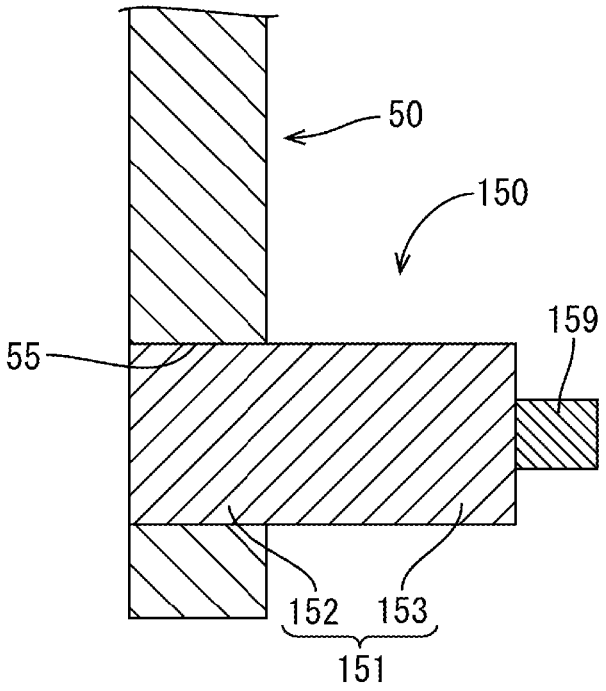
FIG. 8 is a sectional view showing the mounting structure between the metallic shell and the ground electrode in a fifth embodiment.

Next, a fifth embodiment in which the structure of the ground electrode 30 of the first embodiment is partially changed will be described with reference to FIG. 8. The same structural elements as those of the first embodiment are denoted by the same reference numerals, and their descriptions will not be repeated. A ground electrode 150 of the fifth embodiment has a ground electrode body 151 projecting from the hole 55, and an ignition portion 159 fixed to a projecting end of the ground electrode body 151. The ground electrode body 151 has an approximately columnar shape, and has a press-fitted portion 152 press-fitted into the hole 55, and a connecting portion 153 connecting together the press-fitted portion 152 and the ignition portion 159. The press-fitted portion 152 corresponds to the "fixing portion" in the claims. The connecting portion 153 is formed integrally with the press-fitted portion 152. Meanwhile, the connecting portion 153 and the ignition portion 159 are joined together by means of, for example, welding such as laser welding.

The size of the ignition portion 159 is the same as the size of the ignition portion 39 of the first embodiment. The connecting portion 153 has a constant cross-sectional area from the boundary between the press-fitted portion 152 and the connecting portion 153 to its end portion on the side toward the ignition portion 159. Also, the cross-sectional area of the press-fitted portion 152 is the same as the cross-sectional area of the connecting portion 153. Meanwhile, the size of the boundary between the press-fitted portion 152 and the connecting portion 153 is the same as the size of the boundary between the press-fitted portion 32 and the connecting portion 33 in the first embodiment. However, the size of the end portion of the connecting portion 153 on the side toward the ignition portion 159 is larger than the size of the end portion of the connecting portion 33 on the side toward the ignition portion 39 in the first embodiment.

[Details of Sixth Embodiment of Present Disclosure]

Figure 9:
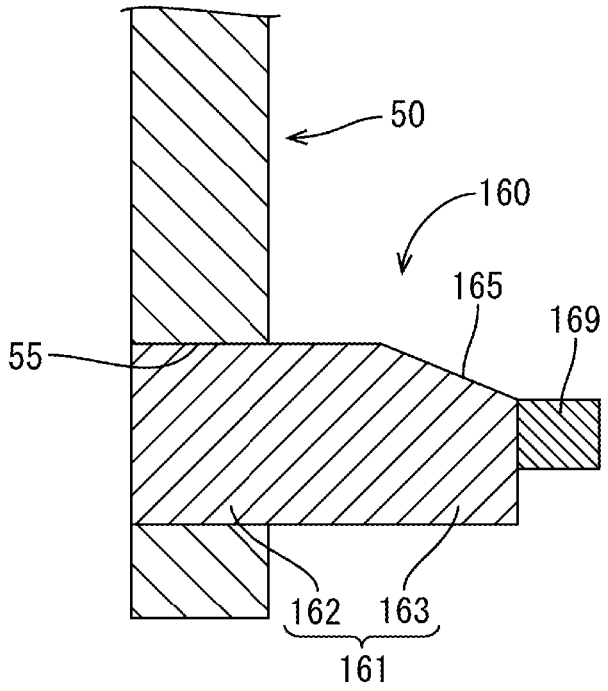
FIG. 9 is a sectional view showing the mounting structure between the metallic shell and the ground electrode in a sixth embodiment.

Next, a sixth embodiment in which the structure of the ground electrode 150 of the fifth embodiment is partially changed will be described with reference to FIG. 9. The same structural elements as those of the first embodiment are denoted by the same reference numerals, and their descriptions will not be repeated. A ground electrode 160 of the sixth embodiment has a ground electrode body 161 projecting from the hole 55, and an ignition portion 169 fixed to a projecting end of the ground electrode body 161. The ground electrode body 161 has an approximately columnar shape, and has a press-fitted portion 162 press-fitted into the hole 55, and a connecting portion 163 connecting together the press-fitted portion 162 and the ignition portion 169. The press-fitted portion 162 corresponds to the "fixing portion" in the claims. The connecting portion 163 is formed integrally with the press-fitted portion 162. Meanwhile, the connecting portion 163 and the ignition portion 169 are joined together by means of, for example, welding such as laser welding.

A taper portion 165 is provided on the rear end surface of the connecting portion 163 of the present embodiment. The taper portion 165 extends from the projecting end of the connecting portion 163 to a position near the center of the connecting portion 163. The length of the taper portion 165 is not limited to the length employed in the present embodiment and may be determined such a manner that the taper portion 165 extends from the projecting end of the connecting portion 163 to the boundary between the press-fitted portion 162 and the connecting portion 163.

[Details of Seventh Embodiment of Present Disclosure]

Figure 10:
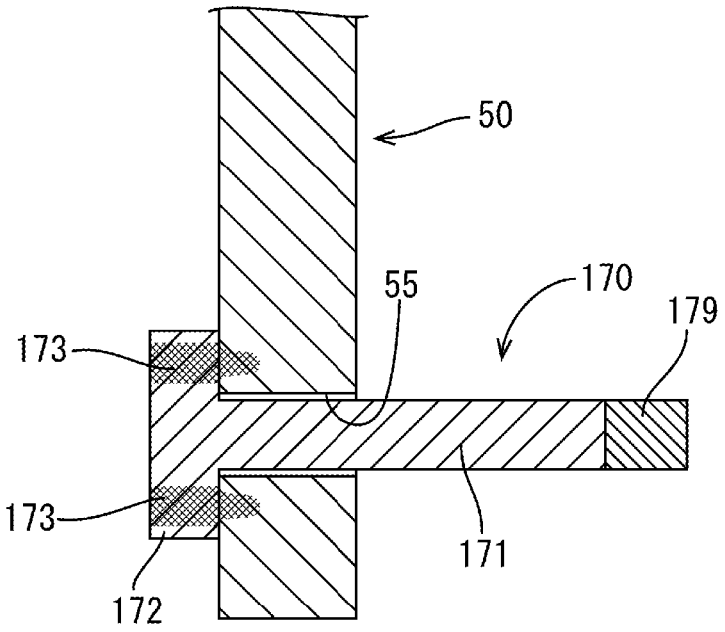
FIG. 10 is a sectional view showing the mounting structure between the metallic shell and the ground electrode in a seventh embodiment.

Next, a seventh embodiment in which the structure of the ground electrode 30 of the first embodiment is partially changed will be described with reference to FIG. 10. The same structural elements as those of the first embodiment are denoted by the same reference numerals, and their descriptions will not be repeated.

A ground electrode 170 of the present embodiment has a ground electrode body 171 inserted into the hole 55, a weld portion 172 integrally provided at the proximal end of the ground electrode body 171, and an ignition portion 179 fixed to the distal end of the ground electrode body 171.

The weld portion 172 corresponds to the "fixing portion" in the claims. The ground electrode body 171 is inserted into the hole 55 from the outer circumferential side of the metallic shell 50, and the weld portion 172 is in contact with the outer circumferential surface of the metallic shell 50. The weld portion 172 is fixed to the outer circumferential surface of the metallic shell 50 by means of welding such as laser welding (hatched regions show fusion regions 173 formed as a result of welding). Laser welding is performed on the weld portion 172 from the outer circumferential surface side of the metallic shell 50, and the fusion regions 173 extend through the weld portion 172 and reach an inner part of the metallic shell 50.

The difference in coefficient of thermal expansion between the metallic shell 50 and the ignition portion 179 is rendered greater than the difference in coefficient of thermal expansion between the metallic shell 50 and the weld portion 172, and the coefficient of thermal expansion of the weld portion 172 is rendered greater than the coefficient of thermal expansion of the ignition portion 179. When an air-fuel mixture combusts, the temperature of the spark plug 100 becomes high. Therefore, the diameter of the hole 55 of the metallic shell 50 increases, and a crack may be formed in the weld portion 172. In an assumed case where the ground electrode body 171 is formed of the same metal as the ignition portion 179, there is a possibility that the weld portion 172 is broken due to growth of the crack, and the ground electrode body 171 comes off the hole 55. In view of this, in the present embodiment, as compared with the coefficient of thermal expansion of the ignition portion 179, the coefficient of thermal expansion of the weld portion 172 assumes a value closer to the coefficient of thermal expansion of the metallic shell 50. Therefore, it is possible to prevent generation of a crack, thereby avoiding damage to the weld portion 172.

Other Embodiments (1) In the first through seventh embodiments, the ground electrode having the connecting portion is shown as an example. However, a ground electrode whose ignition portion is fixed directly to the hole of the metallic shell may be used.

(2) In the first through sixth embodiments, the ground electrode in which the connecting portion and the press-fitted portion are integrally formed is shown as an example. However, the ground electrode may be a ground electrode in which the connecting portion and the press-fitted portion are formed separately, and the connecting portion is welded to the press-fitted portion.

(3) In the first through sixth embodiments, the press-fitted portion is merely press-fitted into the hole of the metallic shell, thereby being fixed thereto. However, the press-fitted portion may be welded by, for example, laser welding performed from the outer circumferential side of the metallic shell in a state in which the press-fitted portion remains on the inner surface of the metallic shell.

DESCRIPTION OF REFERENCE NUMERALS AND SYMBOLS

5: gasket, 6: wire packing, 7: wire packing, 8: plate packing, 9: talc

10: insulator, 12: axial hole, 12L: large inner diameter portion, 12S: small inner diameter portion, 13: leg portion, 15: outer diameter reducing portion, 16: inner diameter reducing portion, 17: forward-end-side trunk portion, 18: rear-end-side trunk portion, 19: flange portion

20: center electrode, 21: center electrode body, 23: head portion, 24: flange portion, 25: leg portion, 29: ignition portion, 295: first discharge surface

30: ground electrode, 31: ground electrode body, 32: press-fitted portion, 33: connecting portion, 34: weld portion, 35: taper portion, 39: ignition portion, 395: second discharge surface (discharge surface)

40: terminal electrode

50: metallic shell (metallic member), 51: tool engagement portion, 52: mounting screw portion, 53: crimp portion, 54: bearing portion, 55: hole, 56: step portion, 58: compressively deforming portion, 59: penetration hole

60: seal member

70: resistor element

80: seal member

100: spark plug

120: ground electrode, 121: ground electrode body, 122: press-fitted portion, 123: connecting portion, 129: ignition portion

130: ground electrode, 131: ground electrode body, 132: press-fitted portion, 133: connecting portion, 136: extension portion, 139: ignition portion

140: ground electrode, 141: ground electrode body, 142: press-fitted portion, 143: connecting portion, 146: extension portion, 149: ignition portion

150: ground electrode, 151: ground electrode body, 152: press-fitted portion, 153: connecting portion, 159: ignition portion

160: ground electrode, 161: ground electrode body, 162: press-fitted portion, 163: connecting portion, 165: taper portion, 169: ignition portion

170: ground electrode, 171: ground electrode body, 172: weld portion, 173: fusion region, 179: ignition portion AX: axis, G: gap Sk: cross-sectional area of the ground electrode at the boundary between the press-fitted portion and the connecting portion, as measured parallel to the axis and perpendicularly to the extension direction of the ground electrode Sh: cross-sectional area of the ground electrode at an end portion of the connecting portion on the side toward the ignition portion, as measured parallel to the axis and perpendicularly to the extension direction of the ground electrode

What is claimed is:

1. A spark plug comprising:

a center electrode;

a metallic member provided to form a tubular shape around an axis of the spark plug and holding the center electrode therein in an insulated state, the metallic member having a hole formed in a side wall of the metallic member and extending in a radial direction; and a ground electrode supported in the hole and extending from the hole toward the axis, wherein the ground electrode has a fixing portion formed of a metal and fixed to the hole, and an ignition portion containing a noble metal, disposed on a side toward the axis in relation to the fixing portion, and having a discharge surface for forming a gap between the ignition portion and the center electrode, wherein an absolute value of a difference in coefficient of thermal expansion between the metallic member and the fixing portion is smaller than an absolute value of a difference in coefficient of thermal expansion between the metalli's c member and the ignition portion, wherein the ground electrode has the fixing portion, the ignition portion, and a connecting portion for connecting together the fixing portion and the ignition portion, and wherein a cross-sectional area of the ground electrode at a boundary between the fixing portion and the connecting portion, as measured parallel to the axis and perpendicularly to an extension direction in which the ground electrode extends, is larger than a cross-sectional area of the ground electrode at an end portion of the connecting portion on a side toward the ignition portion, as measured parallel to the axis and perpendicularly to the extension direction of the around electrode.

2. A spark plug according to claim 1, wherein the fixing portion is press-fitted into the hole, thereby being fixed thereto, and the fixing portion has a coefficient of thermal expansion greater than that of the ignition portion.

3. A spark plug according to claim 1, wherein the fixing portion is formed of Ni or an alloy containing Ni in a largest amount.

4. A spark plug according to claim 1, wherein the connecting portion has a taper portion.

* * * * *